United States Patent [19]

Moss

[11] 4,151,439

[45] Apr. 24, 1979

[54] VEHICLE LIGHT BULB WITH EXTENDING ELECTRICAL WIRES

[76] Inventor: Richard L. Moss, 4321 S. 368th, Auburn, Wash. 98002

[21] Appl. No.: 866,027

[22] Filed: Dec. 30, 1977

[51] Int. Cl.[2] ..... H01J 5/54

[52] U.S. Cl. ..... 313/318; 362/226

[58] Field of Search ..... 313/318; 362/226

[56] References Cited

U.S. PATENT DOCUMENTS

| | | | |
|---|---|---|---|
| 3,137,448 | 6/1964 | Holzhause | 339/154 A X |
| 3,335,389 | 8/1967 | Reichardt | 313/318 X |
| 3,344,265 | 9/1967 | Dillabough, Jr. | 362/226 |
| 3,400,293 | 9/1968 | Reichardt | 313/318 |
| 3,458,849 | 7/1969 | Marks et al. | 339/28 |

*Primary Examiner*—Alfred E. Smith
*Assistant Examiner*—Charles F. Roberts
*Attorney, Agent, or Firm*—Roy E. Mattern, Jr.

[57] ABSTRACT

To connect the respective rear light circuits of a towing vehicle and a trailer, the conventional rear light bulbs of a towing vehicle are replaced with otherwise conventional rear light bulbs, each modified by having extending electrical wires passing from its base contacts upwardly in its conventional round base, while at the same time passing through a depression groove of its otherwise conventional glass envelope, and thereafter freely extending a selected distance for attachment to the rear light circuits of a trailer. These otherwise conventional rear light bulbs with their extending electrical wires are made by a method centering on the selective heating of a portion of the glass of an initially conventional glass envelope to create on its exterior the weathertight depression groove extending for a length slightly longer than the depth of its round base.

6 Claims, 5 Drawing Figures

VEHICLE LIGHT BULB WITH EXTENDING ELECTRICAL WIRES

BACKGROUND OF THE INVENTION

There are several ways of providing more convenient connections between the rear light circuits of a towing vehicle and a trailer, such as illustrated and described in U.S. Pat. Nos. 3,137,448, especially pertaining to an adapter and changing the optical position of the rear light bulb; 3,335,389, having a modified base member with two wire receiving grooves; 3,344,265 appearing to modify a base diameter to accommodate extending wires; 3,400,293 changing a base shape to accommodate extending wires and thereafter having installation difficulties often causing breakage of glass envelopes, and 3,458,849 using an adapter assembly allowing a rear light to freely bounce around in a taillight housing, often discoloring or burning sections of a taillight lens.

These previous ways all have merit, however, there remained a need for a more reliable vehicle rear light bulb with extending electrical wires, which would be accommodated readily in the same optical location and in a conventional socket of a standard specified diameter for most vehicles, and which would not interfere with the continuing concentric placement of the glass envelopes in their respective conventional bases.

SUMMARY OF THE INVENTION

A vehicle light bulb with extending electrical wires is used to reliably connect the respective rear light circuits of a towing vehicle and a trailer. This light bulb with extending electrical wires, continues to place the light filaments at the designed optical location, fits into standard sockets without distortion for its base remains conventional in size and shape, and therefore there is no opportunity of a glass envelope breaking because of any pre-existing distortions causing stresses to occur upon installation.

By using a unique method, a conventional glass envelope is selectively heated to create on its exterior a depression groove extending for a length slightly longer than the depth of the round conventional base to which it is to be fitted. Annealing of the overall glass envelope preferably follows. Thereafter extending electrical wires are positioned in this depression groove and their stripped ends and some of the light filament leads are soldered to create the contacts of the conventional base. Other light filament leads are connected to the conventional base. Then the glass envelope is cemented into place in the conventional base. Protective coverings thereafter may be placed over the extending wires and they in turn may terminate in connector components to complete a preferred embodiment of an electrical accessory product, which is quickly and conveniently used when connecting the respective rear light circuits of a towing vehicle and a trailer.

DESCRIPTION OF THE DRAWINGS

A preferred embodiment of the vehicle light bulb with extending electrical wires used in connecting the respective rear light circuits of a U.S. towing vehicle and a U.S. trailer, wherein each bulb has two elements and the circuit is negatively ground to the vehicle frames, is illustrated in the drawings, wherein.

DESCRIPTION OF THE INVENTION

The Electrical Accessory Product and Its Installation

Figure 1:
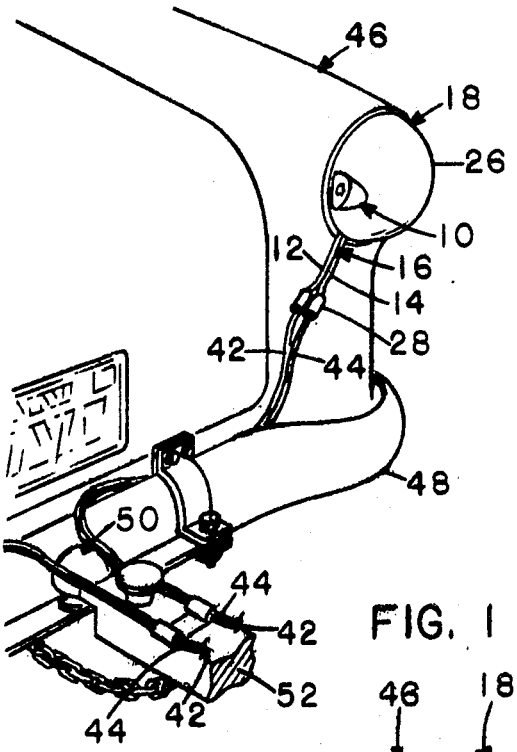
FIG. 1 is a partial rear perspective view of a towing vehicle and portions of a trailer frame tongue and the ball and socket mechanical connection with a safety chain, and also of this electrical accessory product, indicating how its extending electrical wires leave a taillight assembly by the taillight lens to be interconnected with electrical wires of the rear light circuits of the trailer.
Figure 2:
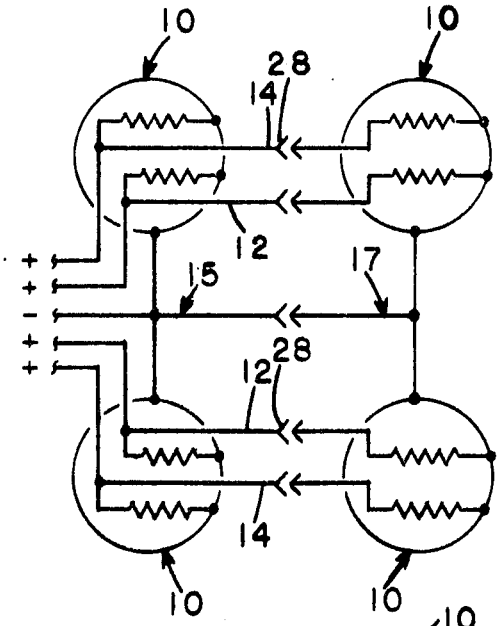
FIG. 2 is a schematic view of the wiring diagram to indicate the interconnection of the rear light circuits of the towing vehicle and the trailer.
Figure 3:
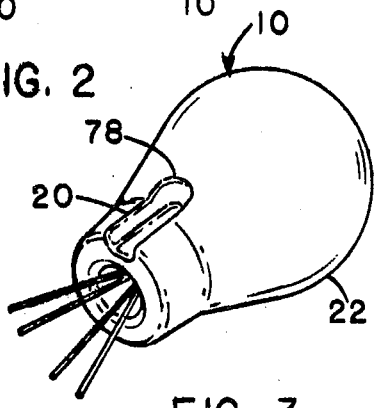
FIG. 3 is a perspective view of the glass envelope to illustrate the depression groove which is made to accommodate portions of the extending electrical wires.
Figure 4:
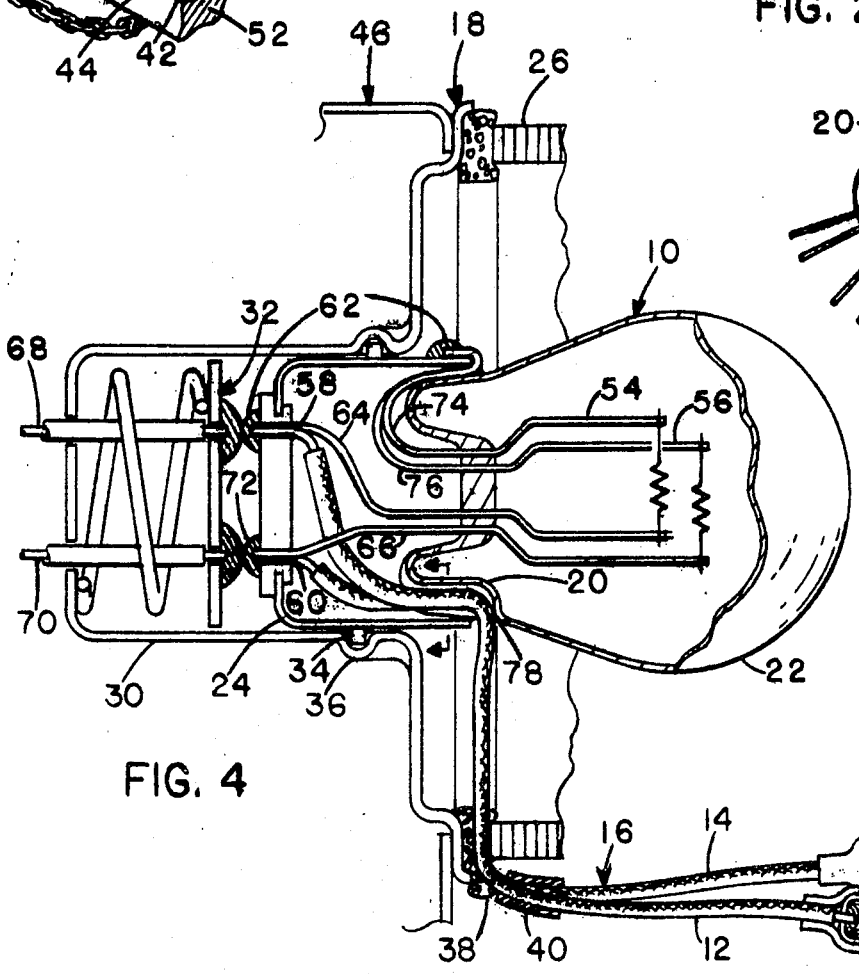
FIG. 4 is an enlargerd partial view, essentially in cross section, illustrating the installation of this electrical accessory product in a taillight lamp socket indicating its positioning in the space previously occupied by a conventional rear light bulb within the taillight assembly, and showing how the extending electrical wires are secured to the round base and then moved together to fit into the depression groove of the glass envelope, while retained within the depth of the round base, and thereafter showing how these extending electrical wires leave the taillight assembly, as they are restrictively cleared from behind the lens of the taillight assembly.
Figure 5:
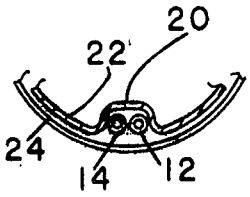
FIG. 5 is a partial sectional view, taken along section line 5—5 of FIG. 4, to illustrate how the extending electrical wires are accommodated in the depression groove of the glass envelope, while being confined by the interior of the round base.

In the drawings, a vehicle light bulb 10 with extending electrical wires 12, 14, serving as a useful vehicle electrical accessory product 16, is illustrated in respect to its installation in a taillight assembly 18, in FIG. 1; its inclusion in the overall respective rear light circuits 15, 17 of a towing vehicle and trailer, in FIG. 2; and its specific arrangement of its components, in FIGS. 3, 4 and 5. In FIGS. 3, 4 and 5, a depression groove 20 is illustrated formed in the glass envelope 22, extending for a length slightly longer than the depth of the round base 24 into which the glass envelope 22 is fitted. Portions of the extending electrical wires 12, 14 are positioned in this depression groove 20 and within the round base 24.

Except for this depression groove 20, the glass envelope 22 is conventional, being derived from a conventional glass envelope. Also the round base 24 is conventional and sized to fit the glass envelope 22. As a consequence, during the preparations for towing a trailer, the conventional vehicle rear light bulbs, not shown, are removed, and these vehicle electrical accessory products 16 are installed in their place. By not tightening the taillight lens 26 too tightly, the extending electrical wires 12, 14, are cleared, for substantial portions of their length, beyond the taillight assembly 18. Preferably each wire is color coded and equipped with convenient connector components 28, with red insulation indicating, on U.S. vehicles and trailers, the brake and signal light circuits, and white insulation indicating the taillight circuit.

When so installed, this vehicle electrical accessory product 16, fits into the towing vehicle rear light socket 30 in the same convenient way the conventional vehicle rear light bulb fits, because the round base 24 of both are of the identical conventional size round base. There is no irregular fitting as occurs in reference to past provisions of other electrical accessory products directed to the same end objectives.

Also when so installed, this vehicle electrical accessory product 16, positions the glass envelope 22, even though modified by the formation of its depression groove 20, in the same optical position of the original equipment vehicle rear light bulb, where it is held just as securely in place. There is no optical position change nor lack of securement, as occurs in reference to past provisions of other electrical accessory products directed to the same end objectives.

The schematic diagram of FIG. 2 is presented for the better overall understanding of the electrical interconnection of the respective rear light circuits 15, 17 of the towing vehicle and trailer. This basic connection has been undertaken previously by others as indicated in patents noted in the background of this invention.

In FIG. 4, in an enlarged cross sectional view, the completed installation of the electrical accessory product 16 is illustrated. The rear light socket 30 of the towing vehicle is not changed and contains the conventional spring backed contact assembly 32. Also the round base 24 with its projections 34 is held in the bayonet type retainers 36. The existing lens gasket 38 is compressed a greater amount at the bottom where the extending electrical wires leave the interior of the taillight assembly 18. The depression groove 20 formed in the glass envelope 22 extends sufficiently above the round base 24, as shown in FIGS. 3 and 4, so the extending electrical wires 12, 14 may be conveniently redirected downwardly to emerge from behind the taillight lens 26. The space provided for the extending electrical wires 12, 14 within the round base 24 by the depression groove 20 is shown in FIG. 5.

After the electrical wires 12, 14 emerge from behind the taillight lens 26, they may be covered by a protective surrounding cover or sleeve 40 extending from near the lens 26 to near the connectors 28, as indicated in FIG. 4. Beyond the connectors 28, the wires 42, 44 of the trailer rear light circuits continue on to carry the electrical energy coming from the towing vehicle 46. These trailer circuit wires 42, 44, coming from respective taillight assemblies 18, in a conventional way, are positioned near the center of the bumper 48 and then directed past the ball and socket interconnection 50 to the tongue 52 of a trailer and on back along the trailer frame to the rear lights of the trailer.

The Method of Manufacture of the Electrical Accessory Product and its Installation The glass envelope 22, inclusive of its two filaments 54, 56, and their resulting four leads, are manufactured by others. Also the round base 24, with two bottom wire lead openings 58, 60 and two outside positioners or projections 34, are manufactured by others. Also obtained from others, are protective covering materials 40, wire to wire connectors 28, insulated wires, 12, 14, solder 62 and cement.

First, during the manufacture, a conventional glass envelope 22 is selectively heated from above to create on its exterior by heating and gravity flow of its own glass, a depression groove 20, still keeping the glass envelope without a direct entry to its interior along this depression groove. Thereafter, upon the installation of this modified glass envelope 22 into the round base 24 and its cementing in place, its interior remains weathertight. Preferably, the glass envelope 22 with its formed depression groove 20 is annealed to withdraw any possible stresses, so upon later handling of this electrical accessory product 16, there will be no danger of glass breakage attributable to this cause.

The extending electrical wires 12, 14 after stripping their ends are matched with respective leads 64, 66 of the taillight filament 54 and the stop or brake and signal light filament 56, generally in reference to U.S. vehicles and trailers, using the color code of the wire insulations with white pertaining to the taillight circuits 68 and red to the stop or brake and signal light circuits 70. After their matching they are inserted through and beyond respective openings or holes 58, 60, in the round base 24 to await their soldering and clipping, etc. to make excellent contact points 72. The other respective leads 74, 76 of the taillight and brake and signal light filaments 54, 56, are secured by solder 62 to the round base 24.

Then the extending electrical wires 12, 14 are positioned in the depression groove 20 and beyond. Thereafter, the glass envelope 20 is cemented into place in the round base 24. This is followed by soldering and clipping, etc. of the combined leads of the filaments 64, 66 and the stripped ends of the extending electrical wires 12, 14 to complete excellent electrical contact points 72 at the round base 24.

Preferably, the red and white coded insulation wires extending about ten inches after leaving the entry 78 of the depression groove 20, are covered by a protective sleeve covering 40. Then the ends of both wires 12, 14 are stripped and fitted with portions of wire to wire connectors 28 to complete the method of manufacture of this electrical accessory product 16. It is a vehicle light bulb 10 with extending electrical wires 12, 14, and when paired with another one of these electrical accessory products 16, it is used in reliably connecting respective rear light circuits 15, 17 of a towing vehicle 46 and a trailer, as indicated by the trailer tongue 52 in FIG. 1.

In reference to vehicles made in other countries, some of the light bulbs have only one filament, and the resulting circuits are different. However, when trailer hook ups are involved, these single filament light bulbs may also be made with a depression groove to accommodate an extending electrical wire.

I claim:

1. Vehicle light bulb with extending electrical wires utilizing a conventional round base and an initially conventional glass envelope, to be installed in lieu of a conventional vehicle light bulb in a towing vehicle, thereby providing the connections for circuits lighting a respective conventional vehicle light bulb on a trailer, comprising:

(a) a conventional round base;

(b) an initially conventional glass envelope having conventionally centered filaments for respective lights and modified by having on its exterior, a depression groove of the glass envelope, and fitted concentrically into the round base with the depression groove located throughout the depth of the round base and extending above the round base to form an entry; and (c) electrical wires extending from a distance away from the round base, down through the entry and beyond within the depression groove and joined to respective light filaments to form respective positive and negative contacts of the round base.

2. A vehicle light bulb with extending wires, as claimed in claim 1, having, in addition, electrical connectors, respectively secured to the respective electrical wires extending upwardly from the round base and beyond for connection with the connectors of the electrical wires coming from the circuits for the trailer lights.

3. A vehicle light bulb with extending wires, as claimed in claim 2, having in addition, a protective insulating cover placed around the respective electrical wires.

4. Vehicle light bulb with an extending electrical wire utilizing a conventional round base and an initially conventional glass envelope, to be installed in lieu of a conventional vehicle light bulb in a towing vehicle, thereby providing a connection for a circuit lighting a respective conventional vehicle light bulb on a trailer, comprising:

(a) a conventional round base;

(b) an initially conventional glass envelope having at least one conventionally centered filament for a respective light and modified by having on its exterior, a depression groove of the glass envelope, and fitted concentrically into the round base with the depression groove located throughout the depth of the round base and extending above the round base to form an entry; and (c) at least one electrical wire extending from a distance away from the round base, down through the entry and beyond within the depression groove and joined to a respective light filament lead to form a respective positive contact of the round base.

5. A vehicle light bulb with an extending wire, as claimed in claim 4, having, in addition, an electrical connector, respectively secured to the extending electrical wire extending upwardly from the round base and beyond for connection with the connector of an electrical wire coming from a circuit for the trailer lights.

6. A vehicle light bulb with an extending wire, as claimed in claim 5, having in addition, a protective insulating cover placed around the extending electrical wire.

* * * * *